United States Patent [19]

Knechtel et al.

[11] 4,216,033

[45] Aug. 5, 1980

[54] METHOD OF NITRIDING STEEL

[75] Inventors: Herbert E. Knechtel, Monroeville Borough; Harry H. Podgurski, Greensburg, both of Pa.

[73] Assignee: United States Steel Corporation, Pittsburgh, Pa.

[21] Appl. No.: 973,501

[22] Filed: Dec. 26, 1978

[51] Int. Cl.[2] ..... C21D 1/48

[52] U.S. Cl. ..... 148/16.6; 148/12.1; 148/20.3; 266/286

[58] Field of Search ..... 148/6.35, 12.1, 16.5, 148/16.6, 20.3; 266/286

[56] References Cited

U.S. PATENT DOCUMENTS

| | | | |
|---|---|---|---|
| 2,392,267 | 1/1946 | Salkover | 266/286 |
| 3,343,999 | 9/1967 | Petermann | 148/16.6 |
| 3,399,085 | 8/1968 | Knechtel et al. | 148/16.6 |
| 3,620,518 | 11/1971 | Winter | 148/16.5 |
| 3,684,590 | 8/1972 | Podgurski | 148/16.6 |

*Primary Examiner*—L. Dewayne Rutledge
*Assistant Examiner*—John P. Sheehan
*Attorney, Agent, or Firm*—Forest C. Sexton

[57] ABSTRACT

Method of nitriding steel surfaces by circulating thereover a ternary mixture of ammonia, hydrogen and water at an elevated temperature and atmospheric pressure. Most of the harmful effects of HCN formation are avoided by utilizing a furnace lining consisting of a coated nickel base alloy, and by adding from 1 to 3% water to the nitriding gas and flowing the nitriding gas at a rate as low as 5 to 20 cu. ft. per hour per 100 sq. ft. of steel surface area.

13 Claims, No Drawings

METHOD OF NITRIDING STEEL

BACKGROUND OF THE INVENTION

U.S. Pat. No. 3,399,085 discloses a process whereby the surface of nitriding steels can be readily nitrided to produce a well-hardened case without the formation of the undesirable brittle outer skin known as "white layer".

In the practice of the patented process, the nitriding time should not depend on the surface area being nitrided. Experience has shown that no problem is encountered in choosing the nitriding time to produce a satisfactory case with a predictable hardness profile as long as a relatively large amount of the specified dry $NH_3$—$H_2$ gas mixture is allowed to flow over a comparatively small work load, e.g. 165 cu. ft. of gas per minute per 100 sq. ft. of steel surface area being nitrided in a non-porous-alundum reactor. There is, however, a serious size limitation on the area of steel that can be nitrided if this flow rate is not maintained particularly in an uncoated Inconel reactor. That is to say, at much lower flow rates the nitriding time needed to produce a given hardness profile can no longer be estimated.

This failure to effect suitable and reproducible nitriding in large areas of steel has been attributed to a drop in concentration of $NH_3$ in the gas mixture which is caused primarily by its decomposition to nitrogen and hydrogen. The problem was, therefore, in part overcome by working at temperatures near the higher end of the permissive range, employing higher concentrations of $NH_3$ and larger flow rates of the nitriding gas mixture. Such practices, however, add considerably to the cost of the operation and do not eliminate the time selection difficulty.

U.S. Pat. No. 3,684,590 discloses a practice wherein the above problems are overcome. The patented practice is based in part upon the discovery that the above-mentioned difficulties are usually not the result of a reduction of $NH_3$ concentration as had been believed, but rather are caused by the generation of impurity gases such as hydrogen cyanide, HCN, in side reactions during nitriding, which inhibit the nitriding reaction. These nitriding inhibitors, or poisons, contaminate the nitriding gas somewhat in proportion to the surface area of the steel being nitrided. Amounts of HCN as little as ten parts per million, can cause excessive and erratic retardation of the nitriding reaction. Pursuant to the patented process therefore, the $NH_3$—$H_2$ nitriding atmosphere is recirculated so that nitriding inhibitors can be removed and so that the moisture content can be regulated as desired to minimize formation of nitriding inhibitors. Specifically, the nitriding atmosphere is circulated from the nitriding furnace to a gas-to-gas heat exchanger where the temperature thereof is lower to a preselected level. Thereafter, the atmosphere is conveyed through a thermostated scrubber containing an aqueous alkaline solution which removes HCN and other nitriding inhibitors. The atmosphere is precooled so that the scrubber temperature can be maintained at a predetermined level, i.e. thermostated, to thereby control the water partial pressure in the atmosphere within the desired range of 7 to 20 torrs depending on the concentration of the aqueous caustic solution. The scrubbed atmosphere is then returned to the nitriding furnace via the heat exchanger.

SUMMARY OF THE INVENTION

This invention is predicated upon our further improvements in the above-described process whereby other techniques can be utilized to suppress the formation of the harmful HCN and/or minimize the harmful affects thereof. Pursuant to one embodiment of this invention, the adverse affects of HCN can in part be avoided without the need for a scrubber, i.e. without the need to recirculate the nitriding atmosphere through a heat exchanger and thermostated scrubber. Nevertheless, a recirculation system substantially as described in U.S. Pat. No. 3,684,590 can be utilized to advantage if so desired. Accordingly, we have found that if the interior surfaces of the nitriding system are made of nickel or high nickel base alloy which are coated with a non-porous and non-friable high temperature material such as enamel or a selected catalyst which will decompose HCN but will not crack ammonia to hydrogen and nitrogen, then the formation for nitriding inhibitors, such as HCN are greatly minimized. Therefore, by combining the desired interior surface material with a system to provide adequate moisture control, the formation of nitriding inhibitors can be reduced to such a low level that a scrubber is not necessary. In addition to the above, the use of a non-porous and non-friable interior surface will provide other advantages as will be discussed.

DESCRIPTION OF THE PREFERRED EMBODIMENTS

While the process disclosed in U.S. Pat. No. 3,399,085 does specifically teach a comparable nitriding process without recirculating the nitriding gas through a scrubber, it was pointed out above, and in U.S. Pat. No. 3,684,590, that successful nitriding pursuant thereto required that large amounts of gas be circulated over comparatively small work loads. Thus, a serious size limitation on work load was inherent unless a scrubber were used. Pursuant to this invention, however, no such size limitation problem is encountered with or without a scrubber.

According to one practice of this invention, the nitriding process is a modified version of the process taught in U.S. Pat. No. 3,399,085. As noted above, one modification is the lining in the nitriding furnace itself. In the practice of this invention, a conventional porous and friable refractory lining is not used, but instead the furnace lining exposed to the nitriding gas is made of a nickel base alloy, and further having a high temperature non-porous and non-friable coating thereon. The coating may be either an inert material such as enamel, or a catalytic material, such as platinum, platinum alloys, or other metals of the second and third transition series (i.e. Ru, Rh, Pd, Os, Ir and Pt) which will decompose HCN but not $NH_3$.

In the practice of the process, the ferrous metal parts to be nitrided are placed in a nitriding furnace having a lining as above described. The parts are then nitrided under conditions which altogether avoid iron nitride nucleation on the surface thereof. This is effected by heating the parts to a preselected temperature within the range 475 to 550° C. while a ternary mixture of ammonia, hydrogen and water, at substantially atmospheric pressure, is passed thereover. The nitrogen activity of the gas mixture is adjusted to a preselected value within the range 0.2 to 1.8 atmos. $-\frac{1}{2}$ which represents a gas composition of from about 15 to 55% ammonia by volume at one atmosphere of pressure. Nitrogen activity can be defined by the equation:

$$\text{Nitrogen activity} = \frac{\text{Partial Pressure of } NH_3 \text{ in atmos.}}{(\text{Partial pressure of } H_2 \text{ in atmos.})^{3/2}}$$

The water content of the nitriding gas mixture should be maintained at a value of from 1 to 3 volume percent, otherwise cyanide generation will proceed at such a rapid rate that a substantially greater gas flow rate will be needed to effect a high nitriding rate.

Upon commencement of the nitriding operation, there will be a higher rate of cyanide formation which continues for about 3 to 7 hours. Thereafter, the cyanide formation rate drops off significantly. It is believed that this initial heavy cyanide formation is due in part to the reaction of ammonia with carbon available at the surface of the steel being case hardened. It follows therefore, that as the surface carbon is depleted, the cyanide formation is reduced. Accordingly, to overcome this effect, the initial nitriding gas flow rate is moderately high, i.e. about an order of magnitude greater than that required when a scrubber is used, or more specifically about 50 to 200 cu. ft. per hour per 100 sq. ft. of steel surface area being nitrided. After this initial period of from 3 to 7 hours, the nitriding gas flow rate is reduced significantly to about 5 to 20 cu. ft. per hour per 100 sq. ft. of steel surface area being nitrided. At both flow rates, it is necessary to maintain the required 1 to 3% water content in the gas. Nitriding should continue at the reduced gas flow rate for a length of time necessary to achieve the degree of hardness desired at specified depths. Nitriding times may vary from several hours to one week.

We have learned that when the nitriding inhibitor contamination is kept low, as in this process, the nitriding rate approaches a diffusion controlled process, which is the maximum rate theoretically possible. At such a nitriding rate, there exists, for any given alloy being nitrided, a nitrogen activity for any given temperature, below which no white layer (iron nitride) can be formed regardless of nitriding time. Thus, maximum case depths without white layer can be obtained in a given time by nitriding slightly below the critical nitrogen activity. The actual preferred nitrogen activity, which is just below the critical, will vary depending upon temperature and the alloy being nitrided. Unfortunately, there is no formula for establishing such critical nitrogen activity, but rather it must be determined experimentally for any given alloy. This can be done by saturating a very thin wafer (0.005") of the alloy under consideration with nitrogen at increasing nitrogen activities until iron nitride ($\gamma' Fe_4N$) is detected. The minimum nitrogen activity at which iron nitride is detected is defined as the critical activity. The table below provides the critical nitrogen activities for two common nitriding alloys at various temperatures.

TABLE

| Alloy* | Temperature (°C.) | Critical Nitrogen Activity (atmos.$^{-\frac{1}{2}}$) |
|---|---|---|
| Nitralloy 135M | 500 | 0.78 |
| Nitralloy 135M | 515 | 0.56 |
| AISI 4140 | 515 | 0.33 |

*Quenched and tempered.

Accordingly, the condition for the second step described in U.S. Pat. No. 3,399,085 is improved upon by following the procedure just described. Furthermore, when the nitriding inhibitors are sufficiently reduced by scrubbing, etc., we recommend the new improved second step treatment as a single treatment when using a single nitriding temperature.

As noted, the primary novel feature of this invention is the provision of coated nickel alloy interior surface of the reactor vessel and system. This would include all interior surfaces which contact the hot nitriding gas mixture. Provision of such a coated surface does not only greatly reduce the formation of nitriding inhibitors, such as HCN, as compared to the usual uncoated nickel alloy surfaces, but also permits much closer control of the nitriding atmosphere composition and more uniform nitriding. That is to say, when using conventional refractory liner surfaces, we have found that because of its porous nature, water and/or ammonia will tend to be absorbed thereinto, and thereafter unpredictably and uncontrollably desorb into the furnace atmosphere during nitriding. Such desorption will lessen the operator's ability to control the critical composition of the furnace atmosphere needed to affect maximum nitriding rates, without danger of producing white layer damage. In addition, because of the friable nature of the refractory lining, dust and particulate matter will settle onto the work load and cause soft spots thereon due to incomplete nitriding thereunder. Pursuant to this inventive process, the provision of a non-porous and non-friable coating within the furnace will eliminate these problems.

As noted above, the non-porous and non-friable coating may be either an enamel or a suitable catalyst. While an enamel serves to provide an inert surface which does not promote the production of HCN, a suitable catalyst, such as a platinum alloy, will go one step further and tend to dissociate any HCN which may be formed at the work load surface. Obviously, a catalytic surface which destroys the harmful HCN is more ideal, but also, it is quite costly, and not absolutely necessary. Since such a catalyst no matter where located could decompose the HCN, it is obvious that if one so chooses, he could provide an enamel coating on the furnace walls and also incorporate the catalyst elsewhere within the system to decompose the HCN.

In another embodiment of this invention the coated furnace interior walls as described above could be incorporated into a system having a recirculation circuit and a scrubber, substantially as described in U.S. Pat. No. 3,684,590. The processing parameters would be identical to those noted above except that it would not be necessary to start with an increased nitriding gas flow rate. Since the scrubber is present to remove the nitriding inhibitors, then it is not necessary to start with the higher flow rate which serves only to dilute the adverse effect of the HCN initially formed on the work load. Accordingly, flow rates of about 5 cu. ft. of gas per hour per 100 sq. ft. of steel surface area being nitrided can be used throughout the entire nitriding operation. In a like manner if a catalytic surface is employed, or a catalyst for decomposing HCN is otherwise incorporated into the system, then the larger initial nitriding gas-flow rate can be reduced in proportion to the effectiveness of the catalyst.

Since this process contemplates addition of water along with the hydrogen and ammonia at the primary gas inlet, it would not be necessary to have a thermostated scrubber if a scrubber were desired. Accordingly, one could use a scrubber and yet eliminate the need for a heat exchanger. In such event, molten alkalis could be used as the scrubber medium. Obviously however, one could if he so chose, utilize a thermostated scrubber containing an aqueous scrubbing solution and thus maintain his water level in that way and not add it to the incoming nitriding gas.

It should also be apparent that since the furnace lining is coated to provide the desired interior surface material, such as enamel, it should not matter what material the lining is made of, so long as it is a non-friable high temperature metal. While indeed a mild steel or other such structural metal or alloy could be used in place of the nickel or nickel base alloy, the nickel or nickel alloy is highly preferred. If one were to use a mild steel lining, for example, he would have to be assured that the coating thereon were without defects. Any subsequent scratches in the coating which would expose even a very small amount of the steel therebeneath could cause the steel lining to be nitrided and thus embrittled. Therefore, nickel or a nickel base alloy, such as Inconel, is highly preferred.

We claim:

1. In the process of nitriding the surface of steel within a nitriding furnace wherein a binary gas mixture of ammonia and hydrogen having a nitrogen activity of from 0.2 to 1.8 atmos. $-\frac{1}{2}$ is circulated over the steel surface at substantially atmospheric pressure and at a temperature within the range 475 to 550° C., the improvement comprising utilizing a nitriding furnace having a lining consisting of a structural metal or alloy coated with a non-porous, non-friable high temperature material which will not crack ammonia to $H_2$ and $N_2$, adding water to the binary gas mixture to provide a water content of from 1 to 3 volume percent and utilizing a gas flow rate of from 5 to 200 cu. ft. per hour per 100 sq. ft. of steel surface area being nitrided.

2. A process according to claim 1 in which said structural metal or alloy consists of nickel or a nickel base alloy.

3. A process according to claims 1 or 2 in which said non-porous, non-friable high temperature material is enamel.

4. A process according to claims 1 or 2 in which said non-porous, non-friable high temperature material is a metal selected from the group consisting of the second and third transition series.

5. A process according to claim 3 in which an initial gas flow rate is provided of from 50 to 200 cu. ft. per hour per 100 sq. ft. of steel surface area being nitrided for an initial period of from 3 to 7 hours, and thereafter reduced to 5 to 20 cu. ft. per hour per 100 sq. ft. of steel surface area being nitrided until the desired hardness profile is obtained.

6. A process according to claim 4 in which a gas flow rate of from 5 to 20 cu. ft. per hour per 100 sq. ft. of steel surface area being nitrided is maintained throughout the entire nitriding process.

7. A process according to claims 1 or 2 in which a metal selected from the group consisting of the second and third transition series is incorporated into the nitriding furnace such that the gas mixture will come into contact therewith to catalytically decompose hydrogen cyanide which may be formed during the nitriding process.

8. A process according to claim 7 in which a gas flow rate of from 5 to 20 cu. ft. per hour per 100 sq. ft. of steel surface area being nitrided is maintained throughout the entire nitriding process.

9. A process according to claims 1 or 2 in which said gas mixture is recirculated through an alkali scrubber to remove hydrogen cyanide therefrom.

10. A process according to claim 9 in which said scrubber contains an aqueous alkaline solution.

11. A process according to claim 9 in which said scrubber contains a molten alkali.

12. A process according to claim 10 in which a gas flow rate of from 5 to 20 cu. ft. per hour per 100 sq. ft. of steel surface area being nitrided is maintained throughout the entire nitriding process.

13. A process according to claim 11 in which a gas flow rate of from 5 to 20 cu. ft. per hour per 100 sq. ft. of steel surface area being nitrided in maintained throughout the entire nitriding process.

* * * * *